US006565057B1

(12) United States Patent
Cohen

(10) Patent No.: US 6,565,057 B1
(45) Date of Patent: May 20, 2003

(54) GAZING GLOBE HOLDER

(75) Inventor: Richard K. Cohen, Ann Arbor, MI (US)

(73) Assignee: RSR Sales, Inc., Ann Arbor, MI (US)

( * ) Notice: Subject to any disclaimer, the term of this patent is extended or adjusted under 35 U.S.C. 154(b) by 652 days.

(21) Appl. No.: 09/326,830

(22) Filed: Jun. 7, 1999

Related U.S. Application Data

(60) Provisional application No. 60/102,541, filed on Sep. 30, 1998.

(51) Int. Cl.[7] ..... A47F 7/00

(52) U.S. Cl. ..... 248/314; 248/318

(58) Field of Search ..... 248/318, 339, 248/315, 314; 362/376, 378

(56) References Cited

U.S. PATENT DOCUMENTS

| | | | | | |
|---|---|---|---|---|---|
| 1,824,343 | A | * | 9/1931 | Gits et al. | 248/318 |
| 2,187,974 | A | * | 1/1940 | Johnson | 248/314 |
| 2,510,708 | A | * | 6/1950 | Marshall | 248/339 |
| 2,810,824 | A | * | 10/1957 | Kaufman | 248/318 |
| D188,205 | S | * | 6/1960 | Hogan | 47/67 |
| 3,638,822 | A | * | 2/1972 | McCoy | 248/318 |
| D244,634 | S | * | 6/1977 | Tamarin | D48/16 B |
| 4,236,195 | A | * | 11/1980 | Kovacik | 362/376 |
| 4,310,874 | A | * | 1/1982 | Spiteri | 362/376 |
| 4,774,647 | A | * | 9/1988 | Kovacik et al. | 362/295 |
| 4,876,824 | A | * | 10/1989 | Newsteder | 47/66 |
| 4,943,025 | A | * | 7/1990 | Warner | 248/318 |
| 5,154,511 | A | * | 10/1992 | Veneskey | 362/376 |
| 5,290,001 | A | * | 3/1994 | Jones | 248/318 |
| 5,957,585 | A | * | 9/1999 | Dabrowski | 248/318 |

OTHER PUBLICATIONS

Ragen, Sep. 1987, US Patent No. 4,691,473, col. 1, lines 10–12.*

Echo Valley Product Catalog, Published 1998, Model Nos. EV 4060, EV 4057, EV 4070 and EV 4075, p. 10.

* cited by examiner

*Primary Examiner*—Ramon O. Ramirez
*Assistant Examiner*—Jon Szumny
(74) *Attorney, Agent, or Firm*—Young & Basile, PC

(57) ABSTRACT

A holder for a circle gazing globe has a receiver for receiving the tubular neck of the gazing globe and a member affixed to the receiver and encircling at least a portion of the gazing globe when the gazing globe is mounted in the receiver. The encircling member takes a variety of forms. In one aspect, a hanger is carried on the encircling member for movably coupling the encircling member and the gazing globe to a fixed support surface. In another aspect, at least two fingers are resiliently coupled to the receiver and have at least one portion engageable with the gazing globe to releasably mount the gazing globe in the receiver.

20 Claims, 3 Drawing Sheets

GAZING GLOBE HOLDER

CROSS REFERENCE TO CO-PENDING APPLICATION

This application claims the benefit of the Sep. 30, 1998 filing date of provisional application Ser. No. 60/102,541 Sep. 30, 1998, the entire contents of which are incorporated herein by reference.

BACKGROUND OF THE INVENTION

1. Field of the Invention

The present invention relates, in general, to garden or landscaping ornamental structures and, more specifically, to gazing globes.

2. Description of the Art

So-called gazing globes have long been used as decorations in gardens and lawns. Such gazing globes are typically formed of a hollow, glass globe which has a small diameter and short length neck extending from the spherical portion of the globe. Gazing globes are provided in different colors, typically with a reflective, mirror finish.

Such globes typically rest and are supported on columns mounted on the ground or in small brackets attached to a wall or other vertical surface. A recess in the top surface of the columns and brackets receives the neck to stationarily position the gazing globe on the column or bracket.

It is also known to support gazing globes in a cylindrical sleeve or receiver which is mounted at one end of a support formed of one or more interconnected metal rods. In all such applications, the spherical portion of the gazing globe is disposed uppermost above the associated support column or collar so as to clearly view from all sides.

It would be desirable to provide a different type of gazing globe holder which provides a different aesthetic appearance, while still providing the necessary globe support function. It would also be desirable to provide a gazing globe holder which is capable of hanging a gazing globe from a support surface.

SUMMARY OF THE INVENTION

One aspect of the present invention is a holder for receiving a decorative gazing globe having a spherical body and a smaller diameter neck extending from the body. In one aspect, the holder includes a receiver which receives the neck of the gazing globe, and a member encircling at least a portion of the globe when the globe is mounted in the receiver. The receiver is joined to or carried on the member.

The receiver is preferably in the form of a hollow, cylindrical member. The encircling member is a tubular member which encircles, in one aspect, substantially all of the circumference of the gazing globe when the gazing globe is mounted in the receiver. In another aspect of the invention, the encircling member encircles less than the entire circumference of the gazing globe. In a specific aspect, the encircling member encircles substantially one-half of the circumference of the gazing globe.

The receiver member and the encircling member are preferably fixedly welded together. In one aspect, the encircling member has an arcuate shape. In another aspect, the encircling member has a polygonal shape. In yet another aspect, the encircling member is in the form of an annular disk having a central aperture through which the globe is disposed when mounted in the receiver.

In another aspect of the present invention, a hanger is carried on the receiver for hanging the gazing globe and the holder on a support. In one example, the hanger is in the form of a hook carried on the encircling member.

The receiver may also be mounted, in another aspect of the present invention, on an upright pedestal or stake for supporting the holder on a horizontal surface, such as the ground, a floor, etc.

In another aspect, the encircling member is in the form of at least two circumferentially spaced members each projecting from the receiver and engageable with the globe when the globe is mounted in the receiver. Each member has a first end affixed to the receiver and an opposed second end. The second end is freely moveable with respect to the first end and preferably disposed radially inwardly of the first end. Each member preferably extends non-planarly between the first and second ends. More specifically, each member preferably extends arcuately between the first and second ends.

The gazing globe holder of the present invention provides a unique ornamental or decorative appearance for a conventional gazing globe while providing support for the gazing globe on the ground or other support. The present holder uniquely enables a gazing globe to rotate under manual force or in the wind when the gazing globe holder carries a hanger connected to a support surface.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
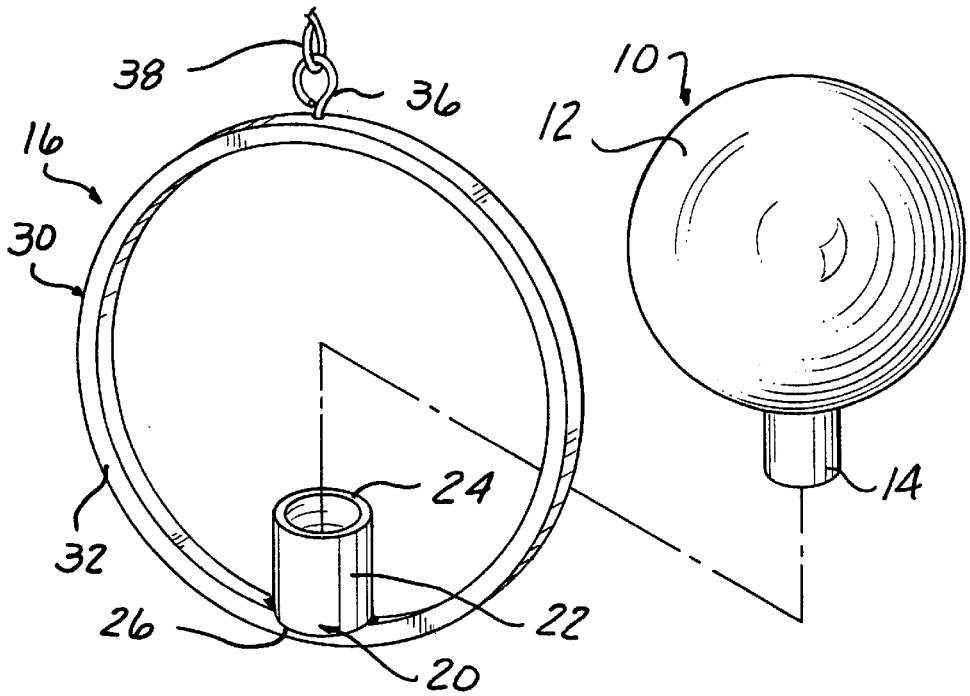
FIG. 1 is an exploded, perspective view of one embodiment of a gazing globe holder according to the present invention
Figure 2:
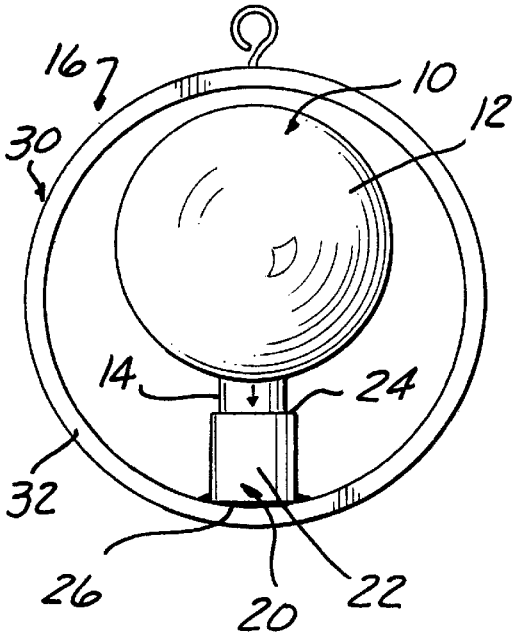
FIG. 2 is a front elevational view of the gazing globe holder shown in FIG. 1.
Figure 3:
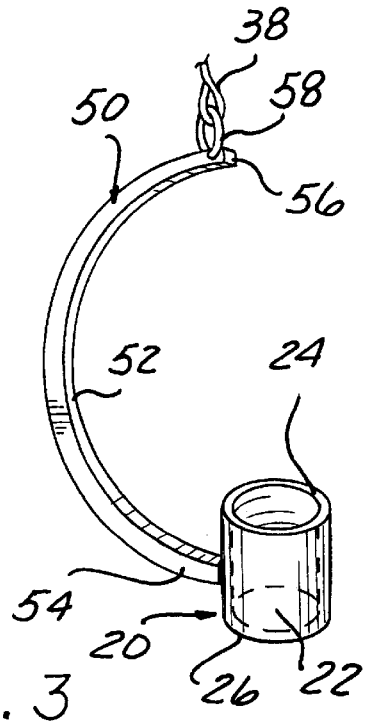
FIG. 3 is a perspective view of another embodiment of a gazing globe holder according to the present invention.

Referring now to the drawing and to FIGS. 1–3, in particular, there is depicted a support or holder which is ideally suited for stationarily supporting a gazing globe 10.

As is conventional, the gazing globe 10 has a spherical portion 12 with a generally cylindrical, tubular neck 14 projecting therefrom. The gazing globe 10 is typically formed of blown glass and has a hollow interior.

In a first embodiment of a gazing globe holder 16 according to the present invention, shown in FIGS. 1 and 2, the holder 16 includes a receiver 20 which functions to snugly receive the small diameter and short length neck 14 projecting from the spherical portion 12 of the globe 10. Although the receiver 20 can take many different forms, by way of example only, the receiver 20 is in the form of a hollow, cylindrical body 22 having a first end 24 and an opposed second end 26. The overall length of the body 22 is approximately the length of the neck 14 of a conventional gazing globe 10.

However, it will be understood that since gazing globes 10 can be provided in different sizes with different diameter spherical portions 12 and different length and diameter necks 14, the body 22 of the receiver 20 can also take many different forms or sizes so as to be snugly receive the neck 14 of one of many different sized gazing globes 10.

Regardless of the size of the neck 14 of the globe 10, the inner diameter of the body 22 of the receiver 20 will be approximately the same as the outer diameter of the neck 14 so as to securely receive and support the gazing globe 10 without substantial movement of the globe 10 in the body 22.

According to the present invention, an encircling member 30 is provided which encircles at least a portion of the outer surface of the spherical portion 12 of the gazing globe 10 when the gazing globe 10 is securely mounted within the receiver 20. The encircling member 30 may be formed of any material, such as metal, plastic, etc., with metal being preferred for long use under harsh exterior conditions.

In one aspect of the invention, the encircling member 30 is in the form of a ring 32 formed of a generally square cross section tube. It will be understood that rectangular, circular or other cross sectional shapes may also be used for the ring 32. The ring 32 may be formed of a continuous member or as an elongated strip which is bent into a circle prior to having the ends of the strip joined together, such as by welding.

The ring 32 is preferably powder coated in any color. The color may match the color of the gazing globe 10 mounted in the receiver 20 or be of a contrasting color, such as black. In the case of a plastic material used to form the ring 32, the selected color is blended with the plastic when molded, extruded, etc.

The ring 32 is fixedly secured to the body 22 of the receiver 20 by welding, mechanical fasteners or other suitable means. In one mounting arrangement shown in FIGS. 1 and 2, the second end 26 of the body 22 of the receiver 20 is mounted on the interior surface of the ring 32 and secured thereto by welding, fasteners, etc. Other mounting arrangements will be described hereafter in conjunction with alternate embodiments of the gazing globe holder of the present invention.

In the aspect of the invention shown in FIGS. 1 and 2, the ring member 32 completely encircles the spherical portion 12 of the globe 10 to provide a unique appearance for the gazing globe 10. In addition, the ring 32 provides an additional feature in that it may be employed to hang the gazing globe 10 from a support, not shown.

As shown in FIGS. 1 and 2, a hanger 36 in the form of a hook, ring or other attachment is carried on the ring 32, generally spaced 180° or directly opposite from the mounting position of the receiver body 22. In one embodiment, the hook 36 has a closed end which extends from a stem mounted through an aperture in the ring 32. One end of the stem 32 is bent or otherwise secured to the ring 32 to mount the hook 36 on the ring 32. A connector member 38, such as a string, wire, cable, etc., may be tied or fastened to the hook 36 to support the entire ring member 32 and the gazing globe 10 mounted therein from an external support, such as a tree, trellis, stand, etc.

In addition to encircling the spherical portion 12 of the gazing globe 10, the ring 32 is also spaced from the exterior surface of the spherical portion 12 of the gazing globe 10 for aesthetic appearance purposes as well as to enable the gazing globe 10 to be inserted into and be removed from the receiver body 22.

FIG. 3 depicts an alternate embodiment of a gazing globe holder 50 according to the present invention. In this aspect of the invention, the holder 50 includes the same receiver 20 described above and shown in FIGS. 1 and 2. The ring member 32 of the first embodiment is replaced by an arcuate or other shaped strip member 52 having opposed first and second ends 54 and 56.

The strip member 52, which is depicted by way of example only as having the same square cross sectional shape and curved radius configuration as the ring member 32 of the first embodiment of the holder 16, will also be understood to be able to be formed with different cross sections and different shapes. The illustrated 180° arcuate shape for the strip member 52 is by way of example only. Other shapes for the strip member 52 will be described hereafter.

The first end 54 of the strip member 52 is fixedly connected to the receiver body 22 by welding, fasteners, etc. In one mounting arrangement, the first end 54 of the strip member 52 may underlie the entire diameter of the receiver body 22, as shown in FIGS. 1 and 2.

However, in the aspect of the invention depicted in FIG. 3, the first end 54 of the strip member 52 may be fixedly secured by means of a mechanical fastener, welding, etc., to the side wall of the body 22 of the receiver 20 to integrally join the strip member 52 and the receiver 20.

An aperture is formed in the second end 56 of the strip member 52 and receives a hook 58. The hook 58 is connectible to a hanger, such as a string or cable 38 as in the first embodiment, to enable the strip member 52 to be hung from an external support, such as a tree, deck, trellis, stand, bracket or other hanger mounted on a wall of a building, home, etc., or in the ground.

The strip member 52 encircles only a portion of the gazing globe 10 mounted in the receiver 20 and is spaced from the exterior surface of the spherical portion 12 of the gazing globe 10 along the entire length of the strip member 52.

In both of the first and second embodiments shown in FIGS. 1–3, since the ring member 32 and the strip member 52 are supported by means of a wire or cable 38 from an external support, the entire holder 30 or 50 may be rotatable about the interconnecting cable 38.

This enables the gazing globe 10 to be rotated either by manual force or by the wind to provide a moving aesthetic appearance which has not been heretofore provided for gazing globes.

Figure 4:
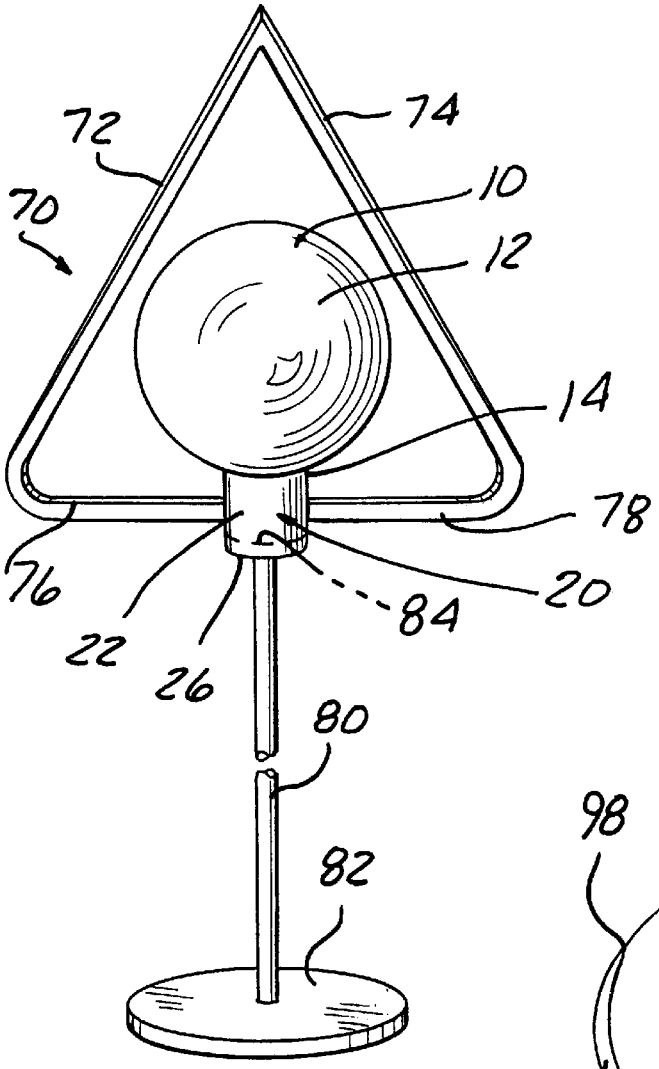
FIG. 4 is a front elevational view of yet another embodiment of a gazing globe holder according to the present invention.

Referring now to FIG. 4, there is depicted yet another aspect of a holder 70 for the gazing globe 10. FIG. 4 depicts two unique aspects of the present gazing globe holder. First, the holder 70, in the embodiment shown in FIG. 4, has a polygonal shape, such as an exemplary triangular configuration, formed of planar or arcuate legs 72, 74, 76 and 78 which may be formed of a single continuous member bent into the desired triangular or other polygonal shape, or provided in a number of separate segments which are joined together, such as by welding, for example, into the polygonal shape.

It will be understood that the specific example of a triangular shape for the holder 70 illustrates the construction of the gazing globe holder of the present invention in any polygonal shape, as well as for other non-polygonal shapes, such as oval. Such polygonal or non-polygonal shapes as well as various design shapes, such as elliptical, oval, serpentine, or other irregular shapes apply equally to a continuous holder, such as holder 30 or to a partial encircling holder, such as holder 50.

In the embodiment shown in FIG. 4, the legs 76 and 78 of the support 70 are spaced apart and secured by welding or fasteners to opposite portions of the side wall of the body 22 of the receiver 20.

The embodiment shown in FIG. 4 also depicts the support 70 as being mounted on a stationary post 80 extending from a base 82 which can be mounted on the ground, floor or other generally horizontal surface. The post 80 could also be mounted directly in the ground without the need for the base 82. A cross bar 84 is mounted interiorly within the body 22 of the receiver 20 generally adjacent to the second end 26 of the body 22. The post 80 is connected to the cross bar 84, such as by welding, for example.

It will be understood that the post 80 may take other configurations as conventional in gazing globe supports or to suit the particular aesthetic appearance of an artist.

Figure 5:
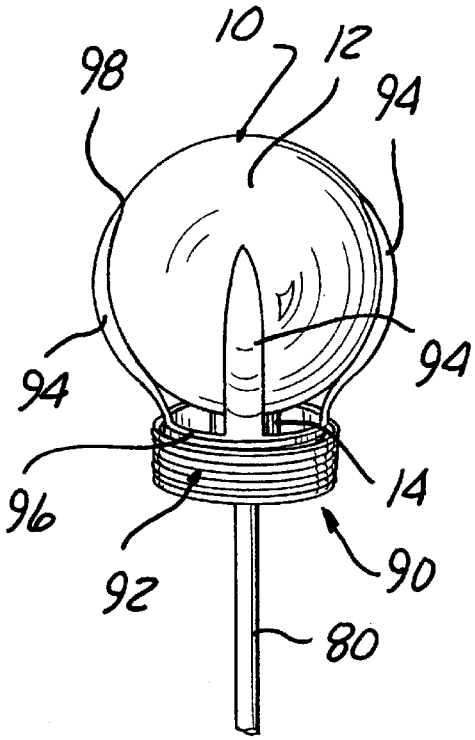
FIG. 5 is a perspective view of yet another embodiment of a gazing globe holder according to the present invention.

Another embodiment of a gazing globe holder 90 is depicted in FIG. 5. In this aspect of the invention, the holder 90 is depicted as being mounted on the post 80 which can be mounted directly in the ground or attached to the base or pedestal 82 as described above and shown in FIG. 4.

The holder 90 includes a receiver 92 which is in the form of a decorative, cylindrical member, such as a tubular wire coil. A cross bar, not shown, may be mounted interiorly within the receiver 92 for connection to one end of the post 80. Alternately, the receiver 92 may take on other forms, such as a smooth exterior tubular member of circular, polygonal or other shape. In this embodiment, by example only, the inner diameter of the receiver 92 is greater than the outer diameter of the neck of the gazing globe 10.

A unique feature of the holder 90 is the formation of the encircling member as a plurality of support fingers, with three support fingers, each denoted by reference number 94, being shown by example only. Each support finger 94 may be individually attached at one end to the receiver 92, such as by welding, soldering, etc. Alternately, as shown in FIG. 5, each of the plurality of support fingers 94 is integrally formed or attached to an annular ring 96 which is fixedly mounted on one end of the receiver 92, by welding, mechanical fasteners or the like. The ring 96 has an inner aperture through which the neck of the gazing globe 10 extends into the receiver 92 in a non-contacting arrangement. It should be noted that at least two and preferably three, four or even more support fingers 94 may be provided on the ring 96.

The support fingers 94 have a flower petal-like shape with a first end connected to the ring 96 and the outer edges smoothly or sharply tapering to an opposed apex or tip 98. As shown in FIG. 5, each of the support fingers 94 extends smoothly outward from the first end connected to the ring 96 such that the tip 98 of each support finger 94 extends radially outward beyond the outer diameter of the ring 96.

The support fingers 94 are preferably formed of a resilient, spring-like material, such as a spring steel. This provides resiliency to each of the support fingers 94.

In a normal relaxed state, the tips 98 of each of the support fingers 94 define an opening which has a diameter smaller than the outer diameter of the gazing globe 10. However, the gazing globe 10 may be easily forced past the tips 98 of the support fingers 94 which urges the tips 98 of the support fingers 94 radially outward allowing the circumference of the gazing globe 10 to pass beyond the tips 98 into a cavity between the inner surfaces of the support fingers 94. Due to the resiliency of the support fingers 94, the tip ends 98 of the support fingers 94 follow the contour of the gazing globe 10 and move radially inward toward their normal, relaxed position to firmly support the gazing globe 10 in the holder 90. In this supporting position, it can be seen in FIG. 5 that the tips 98 of the support fingers 94 engage the gazing globe 10 at a position above the equator of the gazing globe 10.

Figure 6:
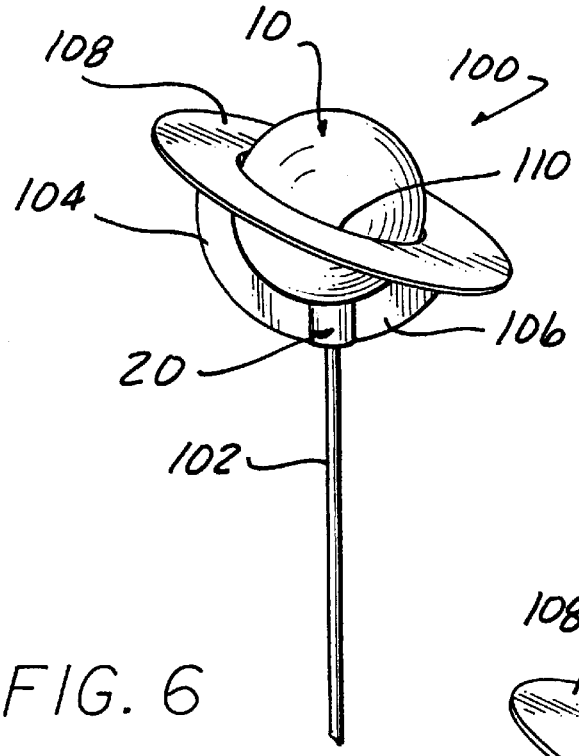
FIG. 6 is a perspective view of yet another embodiment of the gazing globe holder according to the present invention.
Figure 7:
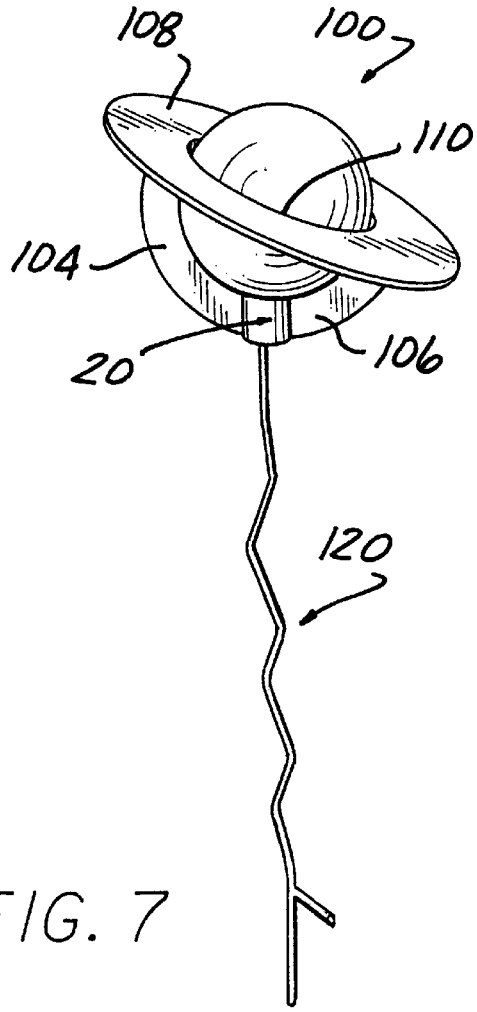
FIG. 7 is a perspective view of the gazing globe holder shown in FIG. 6 with a modified stand.

Referring now to FIGS. 6 and 7, there is depicted yet another aspect of the present gazing globe holder denoted by reference number 100. In this aspect, the holder 100 includes a receiver 20 as described previously for other embodiments of the present invention. A support 102 in the form of an elongated pole or stake is joined at one end to the receiver 20, such as by welding, and projects therefrom for emplacement in the ground to support the receiver 20 above the ground. Alternately, the support 102 could be in the form of a stationary post 80 and base 82 as shown in FIG. 4.

The holder 100 also includes a pair of arms 104 and 106 which are joined at one end to the receiver 20, such as by welding, fasteners, etc., and project outwardly therefrom, generally in an arcuate shape by example only. The arms 104 and 106 may be formed of any suitable material, such as metal, plastic, etc., with metal being preferred due to the normal outdoor use of the gazing globe holder 100, and are formed from a thin metal sheet in identical arcuate shapes having the same radius.

The arms 104 and 106 have different arcuate lengths by example only. The outer ends of each of the arms 104 and 106 are fixedly joined to a disk 108 having a central aperture 110 formed therein. The disk 108 is fixedly joined to the ends of each of the arms 104 and 106 by suitable fastening means, such as welding, rivets, or other mechanical fasteners. Due to the different arcuate length of the arms 104 and 106, the disk 108 is disposed at an angle to horizontal when the holder 100 is mounted in the ground or otherwise supported on an underlying surface.

The central aperture 110 has a diameter to enable the gazing globe 10 to be freely passed therethrough into and out of engagement with the receiver 20. However, an upper portion of the gazing globe 10 projects through the aperture 110 and the disk 108 when the gazing globe 10 is fully mounted in the receiver 20, the gazing globe 10 and the disk 108 bear a decorative resemblance to the planet Saturn.

Although the disk 108 is depicted as having a solid form between inner and outer diametrical edges, it will be understood that the disk 108 may actually be in the form of multiple radially spaced disks interconnected to each other by thin ribs or strips.

FIG. 7 depicts a modified support 120 usable with the gazing globe holder 100 described above and shown in FIG. 6. In this aspect of the invention, the support 120 is shown by example only in the form of a thin rod having multiple bends forming individual angular disposed segments between opposed ends to provide a decorative appearance for the support 120. It will also be understood that the angular segmented shape of the support 120 may also be used with an underlying base 82 as shown in FIG. 4.

Although different shaped encircling members as well as underlying support posts have been individually depicted in various aspects or embodiments of the present invention, it will be understood that the present invention contemplates the use of any of the encircling members with any of the support members in any combination to form a pleasing decorative appearance.

In summary, there has been disclosed a holder for a decorative gazing globe having a conventional spherical body and a small diameter neck extending from the body. The holder includes a receiver for receiving the neck of the globe. A member encircles at least a portion of the globe when the globe is mounted in the receiver. The receiver is fixed to the member.

The receiver preferably comprises a hollow cylindrical member having an inner diameter substantially the same as the outer diameter of the neck of a conventional gazing globe for securely receiving and supporting the gazing globe therein without movement.

The support member, which is disclosed in a plurality of embodiments, encircles at least a portion of or an entire circumference of the gazing globe when the gazing globe is mounted in the receiver.

A hanger is mounted on the support member for hanging the support member and the gazing globe mounted in the receiver on the support member to an external support. This enables the gazing globe and the support to rotate under manual force or by the wind to provide a moving, dynamic decoration. The support may also be stationarily mounted on a post mountable in the ground or to a base or pedestal.

What is claimed is:

1. A decorative apparatus comprising:

a decorative gazing globe having a spherical body and a smaller diameter neck extending from the spherical body; and a holder, the holder including:

a receiver slidably receiving and supporting the neck of the gazing globe; and an encircling member joined to the receiver and encircling at least a portion of the gazing globe when the gazing globe is mounted in the receiver, the encircling member having a planar shape lying in a first plane and interior and exterior surfaces, the receiver mounted on and extending from the interior surface of the encircling member, the encircling member spaced from the decorative gazing globe allowing the decorative gazing globe to be received in and removed from the receiver through the encircling member while the encircling member is joined to the receiver.

2. The decorative apparatus of claim 1 wherein the receiver is a hollow cylinder.

3. The decorative apparatus of claim 1 wherein the encircling member is a tubular member.

4. The decorative apparatus of claim 1 wherein the encircling member encircles substantially all of the circumference of the gazing globe when the gazing globe is mounted in the receiver.

5. The decorative apparatus of claim 1 further comprising:

a hanger carried on the encircling member for hanging the gazing globe holder to a support.

6. The decorative apparatus of claim 5 wherein the hanger is a hook carried on the encircling member.

7. The decorative apparatus of claim 5 wherein the hanger movably couples the globe to a support.

8. The decorative apparatus of claim 1 wherein:

the encircling member is a disk; and the encircling member is a pair of arms joined to and extending between the disk and the receiver for supporting the disk with respect to the receiver.

9. The decorative apparatus of claim 1 further comprising:

a support fixed to the receiver for supporting the holder on a horizontal surface.

10. The decorative apparatus of claim 9 wherein the support is an elongated tubular stake.

11. The decorative apparatus of claim 9 wherein the support is an elongated tubular member joined to a base.

12. The decorative apparatus of claim 1 wherein the receiver is welded to the encircling member.

13. The decorative apparatus of claim 1 wherein the encircling member has an arcuate shape.

14. The decorative apparatus of claim 1 wherein the encircling member has a polygonal shape.

15. A decorative apparatus comprising:

a decorative gazing globe having a spherical body and a smaller diameter neck extending from the spherical body; and a holder, the holder including:

a receiver having first and second ends, the first end slidably receiving and supporting the neck of the gazing globe; and an encircling member joined to the receiver and encircling at least a portion of the gazing globe when the gazing globe is mounted in the receiver, the encircling member having a planar shape lying in a first plane and first and second spaced ends, the first end of the encircling member fixed intermediately the first and second ends of the receiver, the encircling member spaced from the decorative gazing globe allowing the decorative gazing globe to be received in and removed from the receiver through the encircling member while the encircling member is joined to the receiver.

16. The decorative apparatus of claim 15 wherein the encircling member encircles less than all of the circumference of the gazing globe.

17. The decorative apparatus of claim 15 wherein the encircling member is an annular disk having an aperture through which a portion of the gazing globe is disposed.

18. The decorative apparatus of claim 17 further comprising:

a support arm fixed to the receiver and to the encircling member for supporting the encircling member coaxially with the receiver.

19. A decorative apparatus comprising:

a decorative gazing globe having a spherical body and a smaller diameter neck extending from the spherical body; and a holder, the holder including:

a receiver slidably receiving and supporting the neck of the gazing globe; and an encircling member joined to the receiver and encircling at least a portion of the gazing globe when the gazing globe is mounted in the receiver, the encircling member having a planar shape lying in a first plane, first and second spaced ends and interior and exterior surfaces, the receiver mounted on and extending from the interior surface of the encircling member, the encircling member spaced from the decorative gazing globe allowing the decorative gazing globe to be received in and removed from the receiver through the encircling member while the encircling member is joined to the receiver.

20. The decorative apparatus of claim 19 wherein the encircling member encircles substantially one-half of the circumference of the gazing globe.

* * * * *

UNITED STATES PATENT AND TRADEMARK OFFICE

CERTIFICATE OF CORRECTION

PATENT NO. : 6,565,057 B1
DATED : May 20, 2003
INVENTOR(S) : Richard K. Cohen

It is certified that error appears in the above-identified patent and that said Letters Patent is hereby corrected as shown below:

Title page,
Item [*] Notice, should read:
-- Subject to any disclaimer, the term of this patent is extended or adjusted under 35 U.S.C. 154(b) by 0 days. --.

Signed and Sealed this

Thirteenth Day of September, 2005

JON W. DUDAS
*Director of the United States Patent and Trademark Office*